United States Patent [19]

McCarty

[11] Patent Number: 4,862,641

[45] Date of Patent: Sep. 5, 1989

[54] DOOR LATCH AND STOP MECHANISM

[75] Inventor: Franklin R. McCarty, West Terre Haute, Ind.

[73] Assignee: J. I. Case Company, Racine, Wis.

[21] Appl. No.: 82,674

[22] Filed: Aug. 7, 1987

[51] Int. Cl.[4] ..... E05C 17/24

[52] U.S. Cl. ..... 49/394; 292/87; 292/262; 292/271; 292/DIG. 17; 292/DIG. 30

[58] Field of Search ..... 292/91, 87, 88, 89, 292/80, 76, 17, 19, DIG. 17, 271, 262, 337, DIG. 63, 162, DIG. 30; 49/394

[56] References Cited

U.S. PATENT DOCUMENTS

| | | | |
|---|---|---|---|
| 62,337 | 2/1867 | Humiston | 292/262 |
| 270,635 | 1/1883 | Castor | 292/262 X |
| 1,082,909 | 12/1913 | Rixson | 292/262 |
| 1,860,910 | 5/1932 | Taylor | 292/91 X |
| 1,995,775 | 3/1935 | Moore | 292/87 |
| 3,046,043 | 7/1962 | Matteson | 292/337 |
| 3,971,237 | 7/1976 | Rasmussen | 292/87 X |
| 4,614,374 | 9/1986 | Lannert et al. | 292/337 |
| 4,717,184 | 1/1988 | Boyce | 292/262 X |

FOREIGN PATENT DOCUMENTS

| | | | |
|---|---|---|---|
| 971600 | 7/1975 | Canada | 292/76 |
| 194551 | 1/1958 | Fed. Rep. of Germany | 292/87 |
| 2463842 | 4/1981 | France | 292/336.3 |
| 1418844 | 12/1975 | United Kingdom | 292/262 |

*Primary Examiner*—Gary L. Smith
*Assistant Examiner*—Curtis B. Brueske
*Attorney, Agent, or Firm*—Peter N., Ltd. Jansson

[57] ABSTRACT

A latch device for a hinged door including a resiliently flexible latch bar secured to the door and having a free portion extending along the inside of the door to an end portion, near the door edge, which engages a catch by means of the bending and straightening of the latch bar. Preferred embodiments include a stop bar similar to the latch bar, but extending beyond the opposite door edge to engage another catch to hold the door open. The latch and stop bars are preferably a single bar with two free portions at its opposite ends. The catches have bearing surfaces which distort the bar as the door swings to prepare it to snap into locking engagement with the catches. Access to the latch bar, to allow unlatching, is provided through the door.

18 Claims, 3 Drawing Sheets

DOOR LATCH AND STOP MECHANISM

FIELD OF THE INVENTION

This invention is related generally to door latching mechanisms and, more particularly, to door latches used on service doors such as service doors adjacent to tractor engines and the like.

BACKGROUND OF THE INVENTION

A great variety of latch mechanisms have been developed over the years to hold doors of various kinds closed. Some of these are for special types of doors and others are for general usage. They include highly complex latch mechanisms and relatively simple mechanisms.

One type of door requiring a latching mechanism is the service door on an engine housing. Such service doors are typically sheet metal doors covering openings in sheet metal engine housings for tractors and the like. Such service doors are opened frequently to provide access to the engine for purposes of service.

It is highly desirable that service doors function properly and easily. In some cases. such service doors are removed entirely, while in other cases they are opened by swinging on hinges. There are a number of problems and drawbacks with various types of service doors for tractors and the like. This invention is directed to overcoming these problems and drawbacks.

More specifically, many of the connecting and/or latching mechanisms on service doors of the prior art are rather complex and difficult to operate. They often have a number of linked or pivoted parts which are subject to breakage or malfunction and which are susceptible to debilitating attack by corrosion or by clogging with dirt. And, such latch devices are often exposed to view when the service doors are closed, which may not only increase the presence of dirt and/or moisture but also detract from the aesthetic appearance of the engine housing.

While breakdown is a problem for certain latch devices of the prior art, repair is another problem. Repair of latch devices typically requires replacement of parts and frequently requires substantial or extended steps. Jury-rigged latches sometimes are used for years with all the resulting trouble and inconvenience.

Such prior devices are often complex in construction and operation, sometimes requiring tools to open and close. This tends to discourage or delay servicing and repair operations on engines or other apparatus behind such service doors.

In addition, such prior service doors, if not entirely removed for servicing of the engine or for some other purpose, are often not properly supported in an open position and may swing closed or obstruct operations during servicing or the like. Various latch and stop mechanisms have been developed to hold such doors in a desired open position, but the operation of such mechanisms is too often fairly difficult or requires tools or special support pieces.

Finally, many prior door latch and stop mechanisms tend to allow rattling of the door during engine operation, particularly after a period of initial wear. That is, they do not support the doors well in either the closed or the fully open positions.

There is a clear need for an improved service door latch device which will overcome the many problems and drawbacks mentioned above.

OBJECTS OF THE INVENTION

It is an object of this invention to provide an improved latch device, of the type for latching a hinged door in position over an opening, overcoming some of the problems and shortcomings of the prior art.

Another object of this invention is to provide an improved latch device for service doors and the like which is simple in construction and operation and has few moving parts.

Another object of this invention is to provide an improved latch device which may be operated without tools of any kind to hold the door firmly closed.

Another object of this invention is to provide an improved latch device incorporating a stop mechanism to hold the door firmly in an open position.

Another object of this invention is to provide an improved latch device for service doors and the like which is hidden from view behind the door to enhance the aesthetic appearance of the door and the housing of which it is a part.

Another object of this invention is to provide an improved latch device which is shielded from ambient moisture and dirt and the problems which they cause.

Still another object of this invention is to provide a simple latch device which avoids rattling.

Another object of this invention is to provide a latch device which may be easily repaired in the event of any damage.

These and other important objects will be apparent from the descriptions of this invention which follow.

SUMMARY OF THE INVENTION

This invention is an improved latch device overcoming certain problems and disadvantages of prior art devices.

The latch device of this invention is simple in construction, having few moving parts. The device is essentially hidden from view when the door is closed and which allows a simple attractive appearance of the door and protection for the device form excessive dirt and moisture. The device is easily operated without the use of any tools. In the event of damage, it is easily repaired. The latch device provides a substantially rattle-free door. And, in preferred forms, it incorporates an easily operated door stop mechanism.

The latch device of this invention is of the type for latching a hinged door in position over an opening, the door having an inside surface, an outside surface, and proximal and distal edges aligned with near and far edges of the opening. The inside surface of the door, of course, forms a principal door plane, a term used herein for reference in describing the location of certain elements of the invention. The invention is particularly useful for service doors such as the doors of a sheet metal housing for a tractor engine or the like.

The latch device of this invention includes, as its primary part, a resiliently flexible latch bar extending along the inside surface of the door. Such latch bar has a fixed portion secured to the door and a resiliently flexible free portion extending from the fixed portion along the inside surface of the door and near the distal edge of the door to a latch bar end portion which is movable between natural and distorted positions by bending of the latch bar. The latch bar fixed portion is preferably secured to the inside of the door.

The latch device of this invention also includes a latch bar catch member affixed to the far edge of the door opening. The catch member includes a bearing surface which is engaged by the end portion of the latch bar in various positions between the natural and distorted positions of such end portion of the bar.

Highly preferred embodiments of this invention also include a stop bar having, like the latch bar, a fixed portion secured to the door and a resiliently flexible stop bar free portion extending therefrom along the inside surface of the door. The stop bar free portion extends beyond the proximal edge of the door to a stop bar end portion which, like the end portion of the latch bar, is movable between natural and distorted positions by bending of the stop bar.

Such highly preferred embodiments also include a stop bar catch member affixed to the near edge of the opening and having a stop bar bearing surface which is engaged by the stop bar end portion in various positions between the natural and distorted positions of the stop bar end portion.

In the most highly preferred embodiments, the stop bar and the latch bar are a single bar, their fixed portions being a common central portion of such single bar with the aforementioned free portions extending in opposite directions from the central portion to their ends near the opposite door edges. The fixed portion of such single bar is preferably secured to the inside of the door at a position substantially midway between the proximal and distal edges thereof.

The single bar is chosen for its strength and resilient flexibility to allow its proper engagement with the catch members on opposite edges of the door opening.

The bearing surface of the latch bar catch member, which is affixed to the far edge of the door opening, preferably has a closed-door section, a blocking section adjacent to the closed-door section, and a camming section which extends from a lead end to a juncture with the blocking section. The camming section is configured and arranged to cam the end portion of the latch bar, during the final closing movement of the door, from its natural position on the lead end to a distorted position on the juncture.

The latch bar free portion, upon final closing movement of the door, will snap from such juncture portion of the bearing surface onto the closed-door section of the bearing surface. The distortion of the bar and such snapping of the bar is possible by virtue of the resiliently flexible characteristic of the bar. Even on the closed-door section, the bar is somewhat distorted; this serves to hold the bar firmly on the bearing surface such that rattling is avoided.

With this device, the door may be pushed closed and, by virtue of the action of the bar, will automatically be latched closed without any special manipulative step such as turning a knob or other part as is common in certain prior devices.

The catch member which is affixed to the near edge, as noted above has a bearing surface which is engaged by the end portion of the stop bar in various positions between the natural and distorted positions of such stop bar end portion. Such bearing surface has a ramp section and a stop section.

The ramp section of such stop bar bearing surface has a first part which extends from the near edge of the door opening in a direction transverse to the orientation of the stop bar when the door is closed, and a second part which extends from the first part in a direction transverse to the orientation of the stop bar when the door is opened. The second part extends into the opening. The stop section is contiguous with the second part of the ramp section and is itself in the door opening in position to engage the stop bar when the door is wide open.

The ramp section of the stop bar bearing surface is configured and arranged to cam the stop bar end portion, during opening movement of the door, from a position near its natural position while on the first part of the ramp section to a more distorted position while on the second part of the ramp section. This camming action prepares the stop bar free portion to snap onto the aforementioned stop section of the stop bar bearing surface to hold the door open. The ramp section of such bearing surface is preferably the angled edge of an angled edge member.

The stop section of the stop bar bearing member is a notch which has a tapered lead edge and a transverse far edge. The far edge is transverse the path of movement of the stop bar to prevent the stop bar from slipping off the bearing surface. The lead edge is tapered so that substantial external closing force on the door will cause the stop bar to ride out of the notch and allow the door to be closed.

In highly preferred embodiments, an access means on the door provides access to the free portion of the latch bar from a position outside the door and housing. Such access means allows the free portion of the latch bar to be moved manually away from its engagement with the closed-door section of the latch bar bearing surface to allow opening of the door.

Such access means is preferably formed by a recessed portion of the door which intersects the free portion of the latch bar. Such recessed portion of the door preferably has opposed sidewalls defining opposed apertures through which the free portion of the latch bar extends to accommodate its bending and straightening movements. The recessed portion defines a space which, like the latch bar, is entirely behind the principal door plane (previously defined). Such space is of sufficient size to allow manual grasping of the latch bar.

The door preferably has a pair of opposed substantially parallel endwalls defining opposed slots through which the aforementoned free portions of the bar or bars extend. Such slots serve to limit the movement of the bar beyond that movement which is necessary for proper operation. This prevents pointless distortion of the bar.

DETAILED DESCRIPTIONS OF PREFERRED EMBODIMENTS

Figure 1:
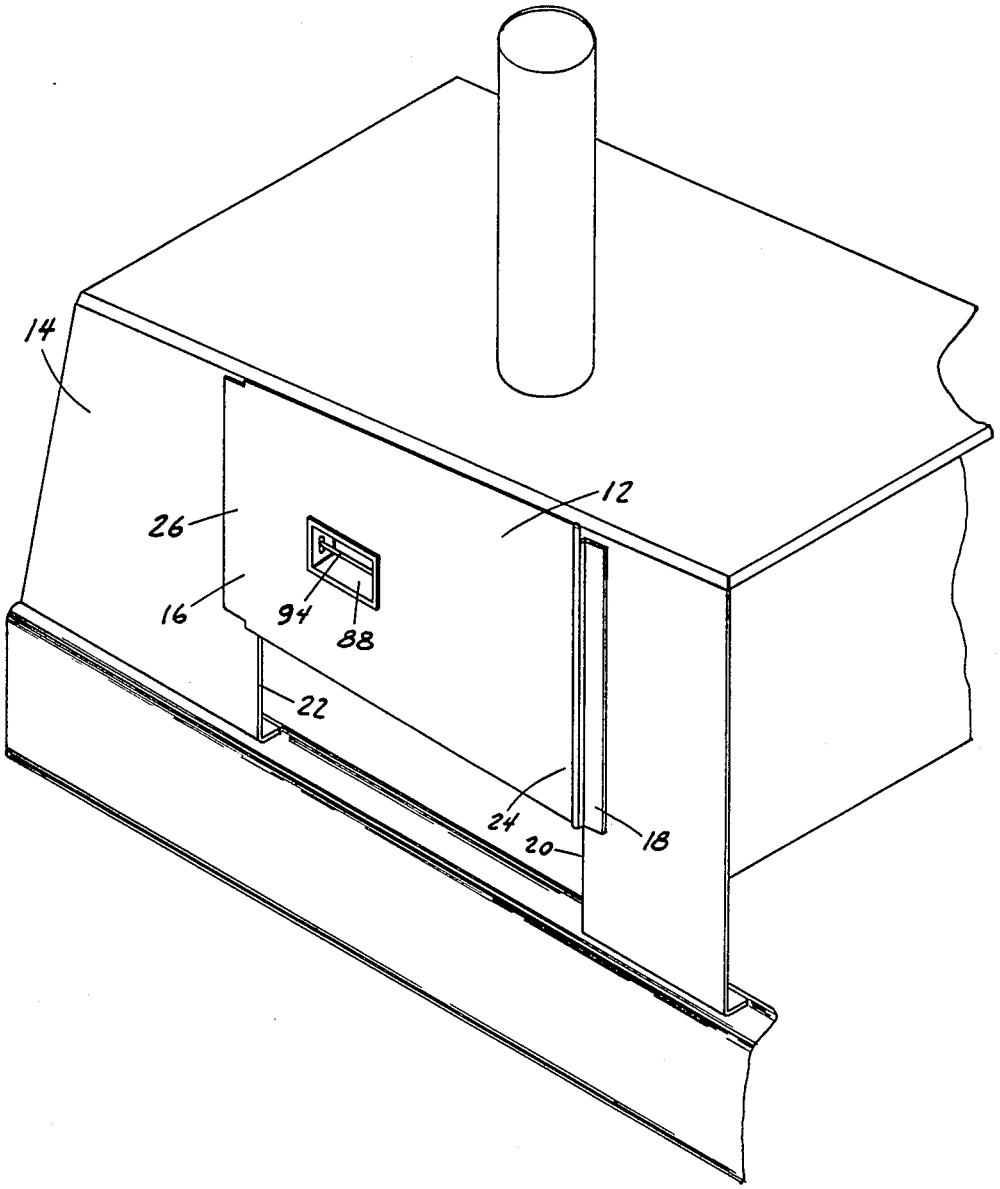
FIG. 1 is a fragmentary perspective view of a tractor engine housing including a hinged service door having a latch device in accordance with this invention.

The drawings illustrate a preferred latch device 10 which is a preferred embodiment of this invention. Latch device 10, most of which is not visible in FIG. 1, is for latching a hinged service door 12 which covers a service opening in an engine housing 14.

Service door 12 has an outside surface 16 and an opposite inside surface and is hinged to engine housing 14 by means of hinge 18. The opening in housing 14 has a near edge 20 (that is, an edge near hinge 18) and a far edge 22, and service door 12 has proximal and distal edges 24 and 26 which are substantially aligned with near and far edges 20 and 22, respectively.

A resiliently flexible bar 28 extends along the inside surface of service door 12. Bar 28 has a fixed central portion 30 which is secured to the inside surface of service door 12 at a position substantially midway between proximal and distal edges 24 and 26. A pair of studs 32 extend from the inside surface of service door 12 and are used for affixing bar 28 to door 12. A pair of spaced female members (33) which are welded or otherwise secured to fixed central portion 30 of bar 28 are engaged with studs 32 and held in place by means of washers 34 and nuts 36.

Bar 28 is a unitary bar and forms both a latch bar 38 and a stop bar 40. Latch bar 38 extends from its connection with the door toward distal edge 26 of door 12, and stop bar 40 extends from connection with the door toward proximal edge 24 of door 12.

Latch bar 38 includes a resiliently flexible free portion 42 which extends from fixed portion 30 along the inside surface of door 12 and near distal edge 26 to a latch bar end portion 44. Likewise, stop bar 40 includes a stop bar free portion 46 which extends from fixed portion 30 along the inside surface of door 12 and beyond proximal edge 24 to a stop bar end portion 48. End portions 44 and 48 are each movable between natural and distorted positions by bending of bar 28.

Service door 12 includes a pair of opposed parallel endwalls 50 and 52 which are near distal and proximal edges 26 and 24, respectively. Endwalls 50 and 52 define opposed slots 54 and 56, and free portions 42 and 46 extend through slots 54 and 56, respectively. Slots 54 and 56 serve to limit the bending of bar 28 to an amount sufficient for the latching, unlatching, stopping and unstopping functions of latch device 10. Slot 56 has a lateral access opening 58 the sole purpose of which is to simplify the assembly of bar 28 with service door 12.

A latch bar catch member 60 is affixed to far edge 22 of the opening by means of adjustable attachment to a mounting bracket 62 secured directly to far edge 22. Bracket 62 supports catch member 60 at a position beyond endwall 50 in the path of movement of latch bar end portion 44 during the final closing movement of door 12. Catch member 60 has a bearing surface 64 along its lower edge which is engaged by latch bar end portion 44 in various positions between its natural and distorted positions.

Bearing surface 64 includes a closed door section 66 where latch bar end portion 44 rests when service door 12 is closed. In this position, free portion 42 of latch bar 38 is preferably near its natural position, with some but not a great deal of distortion. Some distortion is desirable in order to hold latch bar end portion 44 firmly on closed-door section 66 of bearing surface 64, in order to avoid rattling.

Bearing surface 64 also includes a blocking section 68 adjacent to closed-door section 66. Blocking section 68 is normal or nearly normal to the direction of bar movement during opening movement of service door 12, thus keeping service door 12 closed unless free portion 42 of latch bar 38 is bent to a more distorted position to free it from blocking section 68.

Bearing surface 64 also includes a camming section 70 which extends from a lead end 72 to a juncture 74 with blocking section 68. Camming section 70 is configured and arranged to cam latch bar end portion 44, during closing movement of service door 12, from the natural (undistorted) position on lead end 72 to a distorted position on juncture 74 from which free portion 42 will snap onto closed-door section 66 as the door-closing movement is completed. During such the final closing movement of door 12, latch bar end portion 44 travels on camming section 70 and is progressively more distorted until the final snapping motion.

Affixed to near edge 20 is a stop bar catch member 76 which has a bearing surface 78 engaged by stop bar end portion 48. Bearing surface 78 supports stop bar end portion 48 in various positions between its natural and distorted positions and serves to progressively distort stop bar free portion 46 and ultimately hold it in a position which supports service door 12 in a fully opened position.

Stop bar bearing surface 78, unlike latch bar bearing surface 64, is engaged by bar 28 at all times, through at least 90 degrees of door movement. For this reason, bearing surface 78 is more complex, extending in different directions.

More specifically, stop bar bearing surface 78 includes a ramp section 80, which has a first part 82 and a second part 84, and a stop section or notch 86. First part 82 of ramp section 80 extends from near edge 20 in a direction which is transverse to the orientation of stop bar 40 when door 12 is closed. Second part 84 of ramp section 80 extends from first part 82 in a direction transverse to the orientation of stop bar 40 when door 12 is open. Second part 84 extends into the opening.

Ramp section 80 cams stop bar end portion 48, during opening movement of the door, from a position near its natural position while on first part 82 of ramp section 80 to a more distorted position while on second part 84 of ramp section 80, such that stop bar free portion 46 will snap into notch 86 to hold the door open when it reaches the fully opened position.

Stop section or notch 86 is contiguous with second part 84 of ram section 80 and is itself in the opening to engage stop bar end portion 48 when door 12 is fully opened. Notch 86 has a tapered lead edge 85 and a transverse far edge 87. Far edge 87 is transverse to the path of stop bar 40 during opening to prevent it from leaving bearing surface 78. Lead edge 85 is tapered such that closing force applied to the door causes stop bar 40 to ride out of notch 86 to allow door 12 to be closed.

Figure 3:
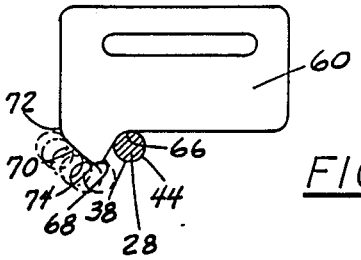
FIG. 3 is an enlarged fragmentary right elevation view, with the bar shown in section, illustrating the latch bar catch member used for holding the door closed.
Figure 4:
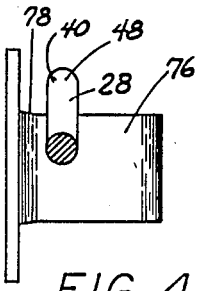
FIG. 4 is an enlarged fragmentary left elevation view, with the bar shown in section, illustrating the stop bar catch member when the door is closed.
Figure 5:
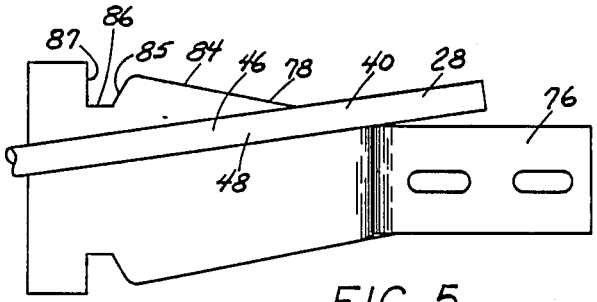
FIG. 5 is a right elevation of FIG. 4.
Figure 6:
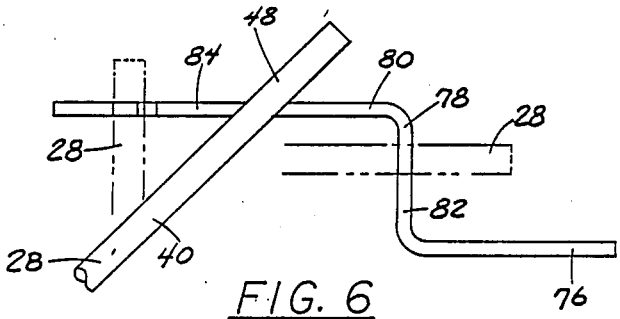
FIG. 6 is a top view of the stop bar catch member, illustrating the stop bar in full lines in an intermediate position and in phantom lines in the closed and full open positions.
Figure 7:
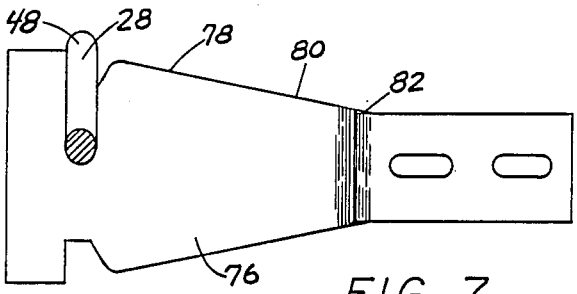
FIG. 7 is another view similar to FIG. 5, but illustrating the stop bar catch member and stop bar in full open position.

FIG. 3 illustrates the position of latch bar 38 on bearing surface 64 when door 12 is closed, and illustrates in phantom lines the progressive movement of latch bar 38 on camming section 70. FIGS. 4 and 5 illustrate the position of stop bar 40 on bearing surface 78 when the door is closed. The phantom lines on the right side of FIG. 6 show this same position. The full lines in FIG. 6 illustrate an intermediate position, while FIG. 7 and the phantom lines on the left side of FIG. 6 show the fully opened stop position.

Figure 2:
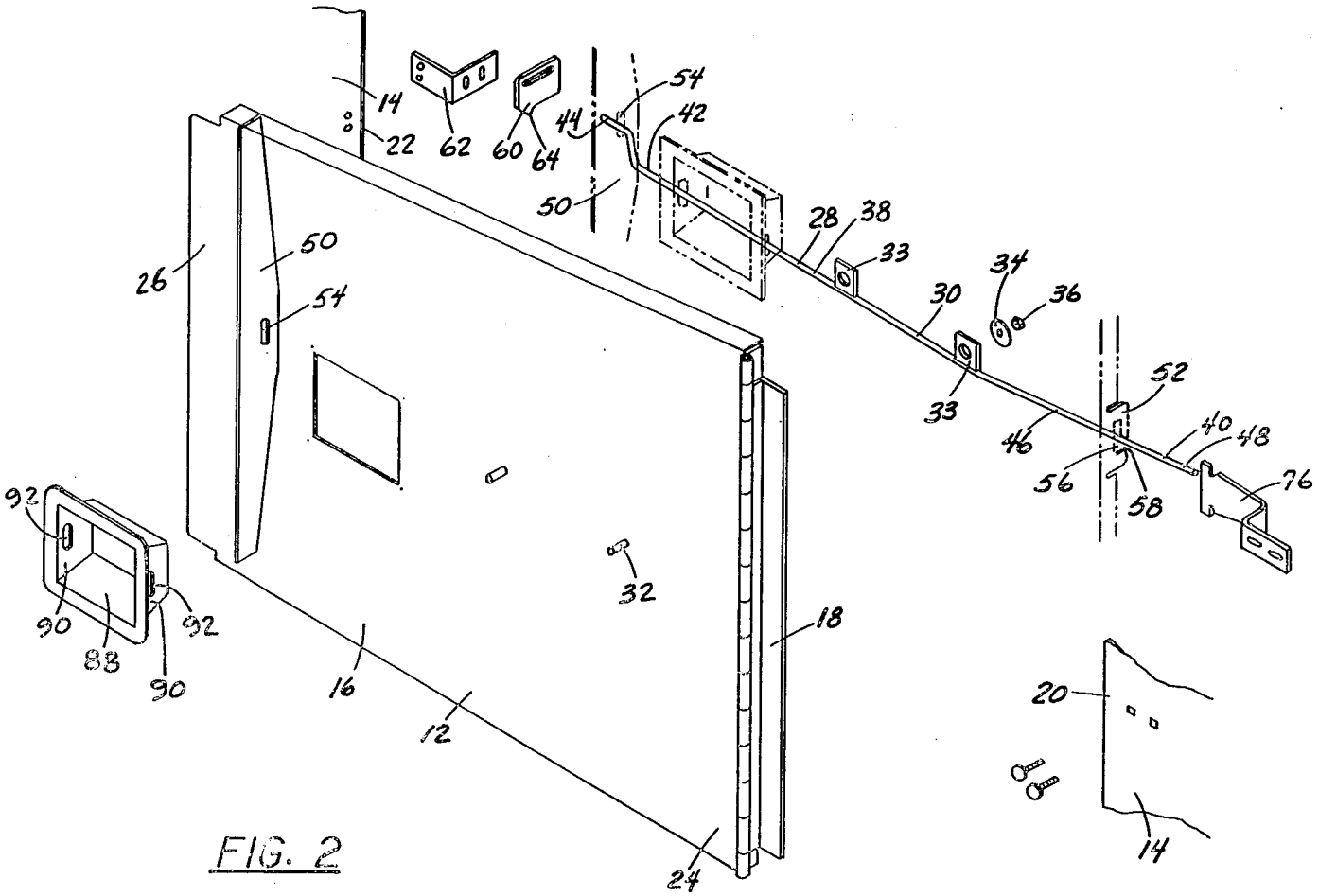
FIG. 2 is an exploded, fragmentary, transparent view of FIG. 1, illustrating the hinged door and latch device.

As illustrated best in FIGS. 2 and 6, stop bar catch member 76 is an angled member and ramp section 80 on it is an angled edge. While an angled member of the type shown is preferred to form bearing surface 78, the direction of ramp section 80 can change more gradually or in more stages to accommodate the changing orientation of stop bar 40 during the opening of door 12.

As illustrated in FIGS. 1 and 2, an access means is provided on door 12 to allow operation of latch bar 38 from a position outside the housing 14. Thus, latch device 10 may be operated from the outside even though catch members 60 and 76 and nearly all of bar 28 are shielded behind 12 and housing 14.

The access means for latch bar 38 includes a recessed portion 88 of door 12. Recessed portion 88 is positioned such that it is intersected by latch bar free portion 42. Recessed portion 88 has opposed sidewalls 90 defining opposed apertures 92 through which latch bar 38 extends. Apertures 92 are slots to accommodate the operational movements of latch bar 38.

To open the door, an operator simply grasps the exposed portion 94 of latch bar 38 and depresses it such that latch bar end portion 44 disengages closed-door section 66 and frees service door 12 to be opened.

The latch device of this invention may be made of readily available materials and parts. Resiliently flexible bar 28 is preferably made of common steel bar stock of cylindrical configuration, although other strong resiliently flexible materials are acceptable as well. The nature of the material, the length of the bar, and its cross-sectional size and shape all have a bearing on its resiliently flexible characteristics. Acceptable choices for bar materials will be apparent to those skilled in the art who are familiar with this invention.

While it is highly preferred that a single bar be used, separate bars may be used for the latching and stopping functions. Such bars may overlap each other or be arranged in many other configurations. Many variations are possible in the manner in which the bar is attached to the door. Many variations are possible in the nature and shape of the catch members.

While the principles of this invention have been described in connection with specific embodiments, it should be understood clearly that these descriptions are made only by way of example and are not intended to limit the scope of the invention.

What is claimed:

1. In a latch device of the type for latching a hinged door in position over an opening, the door having an outside surface, an inside surface forming a principal door plane, and proximal and distal edges substantially aligned with near and far edges of the opening, the improvement comprising:

a latch having a fixed portion secured to the door and a substantially straight resiliently flexible free portion, which includes a mid-portion adjacent to the fixed portion and extends from the fixed portion along the inside surface and near the distal edge to a catch-engaging end portion remote from the fixed portion, said catch-engaging end portion being movable between natural and distorted positions by the bending of the latch bar, the free portion being entirely behind the principal door plane;

a latch bar catch member affixed to the far edge and having a bearing surface engaged by the end portion in positions between the natural and distorted positions, the bearing surface having a closed-door section against which the end portion of the latch bar is engaged when the door is closed; and means in the door providing access to space entirely behind the principal door plane of sufficient size for manually grasping the mid-portion of the latch bar behind the principal door plane from a position adjacent to the outside surface, said free portion extending entirely across said space such that only the mid-portion of the latch bar is exposed from the front of the door, whereby the free portion may be manually distorted away from its engagement with the closed-door section to allow opening of the door.

2. The latch device of claim 1 wherein the bearing surface further comprises:

a blocking section adjacent to the closed-door section; and a camming section extending from a lead end to a juncture with the blocking section and arranged to cam the end portion, during closing movement of the door, from the natural position on the lead end to a distorted position on the juncture from which the free portion will snap onto the closed-door section.

3. The latch device of claim 1 wherein the door includes a recessed portion intersecting the free portion of the latch bar to form said access.

4. The latch device of claim 3 wherein the recessed portion of the door has opposed sidewalls defining opposed apertures, the latch bar free portion extending through the apertures.

5. The latch device of claim 1 wherein the latch bar fixed portion is secured to the inside surface of the door.

6. The latch device of claim 1 comprising:

a stop bar having a fixed portion secured to the door and a resiliently flexible stop bar free portion extending along the inside and beyond the proximal edge to a stop bar end portion movable between natural and distorted positions by bending of the stop bar; and a stop bar catch member affixed to the near edge and having a stop bar bearing surface engaged by the stop bar end portion in positions between the natural and distorted positions of the stop bar end portion.

7. In a latch device of the type for latching a hinged door in position over an opening, the door having an inside surface, an outside surface, and proximal and distal edges substantially aligned with near and far edges of the opening, the improvement comprising:

a latch bar having a fixed portion secured to the door and a resiliently flexible free portion extending from the fixed portion along the inside surface and near the distal edge to an end portion movable between natural and distorted positions by the bending of the latch bar;

a latch bar catch member affixed to the far edge and having a bearing surface engaged by the end portion in positions between the natural and distorted positions;

a stop bar having a fixed portion secured to the door and a resiliently flexible stop bar free portion extending along the inside surface and beyond the proximal edge to a stop bar end portion movable between natural and distorted positions by bending of the stop bar; and a stop bar catch member affixed to the near edge and having a stop bar bearing surface engaged by the stop bar end portion in positions between the natural and distorted positions of the stop bar end portion, said stop bar bearing surface including:

a ramp section having a first part extending from the near edge transverse to the stop bar when the door is closed and a second part extending from the first part transverse to the stop bar when the door is open and into the opening; and a stop section contiguous with the second part of the ramp section and in the opening to engage the stop bar end portion when the door is open, whereby the ramp section cams the stop bar end portion, during opening movement of the door, from a position near its natural position while on the first part of the ramp section to a more distorted position while on the second part of the ramp section such that the stop bar free portion will snap onto the stop section to hold the door open.

8. The latch device of claim 7 wherein the ramp section is an angled edge of an angled edge member.

9. In a latch device of the type for latching a hinged door in position over an opening, the door having an inside surface, an outside surface, and proximal and distal edges substantially aligned with near and far edges of the opening, the improvement comprising:

a latch bar having a fixed portion secured to the door and a resiliently flexible free portion extending from the fixed portion along the inside surface and near the distal edge to an end portion movable between natural and distorted positions by the bending of the latch bar;

a latch bar catch member affixed to the far edge and having a bearing surface engaged by the end portion in positions between the natural and distorted positions;

a stop bar having a fixed portion secured to the door and a resiliently flexible stop bar free portion extending along the inside surface and beyond the proximal edge to a stop bar end portion movable between natural and distorted positions by bending of the stop bar;

a stop bar catch member affixed to the near edge and having a stop bar bearing surface engaged by the stop bar end portion in positions between the natural and distorted positions of the stop bar end portion; and said stop bar and said latch bar being a single bar, the fixed portions being a common central portion of said single bar with the latch bar free portion and stop bar free portion extending in opposite directions from the central portion.

10. The latch device of claim 9 wherein the door includes a pair of opposed substantially parallel endwalls defining opposed slots through which the free portions extend, thereby limiting bending of the the free portions.

11. The latch device of claim 9 wherein the fixed portion of the single bar is secured to the inside surface of the door at a position substantially midway between the proximal and distal edges thereof.

12. The latch device of claim 11 further comprising access means on the door between the midway position and the distal edge to provide access to the latch bar free portion from a position adjacent to the outside surface, whereby the latch bar free portion may be moved manually away from its engagement with the closed-door section to allow opening of the door.

13. The latch device of claim 12 wherein the door includes a recessed portion intersecting the latch bar free portion to form the access means.

14. The latch device of claim 13 wherein the recessed portion of the door has opposed sidewalls defining opposed apertures, the latch bar free portion extending through the apertures.

15. The latch device of claim 12 wherein the stop bar bearing surface comprises:

a ramp section having a first part extending from the near edge transverse to the stop bar when the door is closed and a second part extending from the first part transverse to the stop bar when the door is open and into the opening; and a stop section contiguous with the second part of the ramp section and in the opening to engage the stop bar end portion when the door is open;

whereby the ramp and stop sections cam the stop bar end portion, during opening movement of the door, from a position near its natural position while on the first part of the ramp section to a more distorted position while on the second part of the ramp section such that the stop bar free portion will snap onto the stop section to hold the door open.

16. The latch device of claim 15 wherein the ramp section is an angled edge member.

17. The latch device of claim 16 wherein the door includes a recessed portion intersecting the latch bar free portion to form the access means.

18. The latch device of claim 17 wherein the recessed portion of the door has opposed sidewalls defining opposed apertures, the latch bar free portion extending through the apertures.

* * * * *

UNITED STATES PATENT AND TRADEMARK OFFICE

CERTIFICATE OF CORRECTION

PATENT NO. : 4,862,641

DATED : September 5, 1989

INVENTOR(S) : Franklin R. McCarty

It is certified that error appears in the above-identified patent and that said Letters Patent is hereby corrected as shown below:

In claim 1, line 7, after "latch" insert --bar--.

On the first page, change the name of the attorney of record from "Peter N., Ltd. Jansson" to --Peter N. Jansson, Ltd.--.

In column 1, line 25, change "cases." to --cases,--.

In column 4, line 47, change "aforementoned" to --aforementioned--.

In column 6, line 55, change "ram" to --ramp--.

Signed and Sealed this

Twenty-eighth Day of August, 1990

*Attest:*

HARRY F. MANBECK, JR.

*Attesting Officer*

*Commissioner of Patents and Trademarks*